US006261669B1

(12) United States Patent
Yang et al.

(10) Patent No.: US 6,261,669 B1
(45) Date of Patent: Jul. 17, 2001

(54) FULL RANGE INK JET RECORDING MEDIUM

(75) Inventors: Sen Yang, Warwick, RI (US); Miaoling Huang, Danielson, CT (US); Dave Atherton, Saunderstown; Steven J. Sargeant, West Warwick, both of RI (US); Kang Sun, North Attleboro, MA (US)

(73) Assignee: Arkwright Incorporated, Fiskeville, RI (US)

( * ) Notice: Subject to any disclaimer, the term of this patent is extended or adjusted under 35 U.S.C. 154(b) by 0 days.

(21) Appl. No.: 09/226,613

(22) Filed: Jan. 7, 1999

Related U.S. Application Data

(63) Continuation of application No. 08/919,815, filed on Aug. 29, 1997, now Pat. No. 5,888,635, which is a continuation of application No. 08/630,987, filed on Apr. 12, 1996, now abandoned, which is a continuation of application No. 08/288,265, filed on Aug. 11, 1994, now abandoned, which is a continuation-in-part of application No. 08/287,357, filed on Aug. 8, 1994, now abandoned.

(51) Int. Cl.[7] ..... B41M 5/00

(52) U.S. Cl. ..... 428/195; 428/213; 428/328; 428/329; 428/331

(58) Field of Search ..... 428/212, 195, 428/211, 323, 328, 329, 331, 213

(56) References Cited

U.S. PATENT DOCUMENTS

| | | |
|---|---|---|
| 3,870,549 | 3/1975 | Ruygrok . |
| 3,889,270 | 6/1975 | Hoffmann et al. . |
| 4,503,111 | 3/1985 | Jaeger et al. . |
| 4,578,285 | 3/1986 | Viola . |
| 4,592,951 | 6/1986 | Viola . |
| 4,780,356 | 10/1988 | Otouma et al. . |
| 4,879,166 | 11/1989 | Misuda et al. . |
| 4,954,395 | 9/1990 | Hasegawa et al. . |
| 5,101,218 | 3/1992 | Sakaki et al. . |
| 5,102,717 | 4/1992 | Butters et al. . |
| 5,104,730 | 4/1992 | Misuda et al. . |
| 5,141,599 | 8/1992 | Jahn et al. . |
| 5,206,071 | 4/1993 | Atherton et al. . |
| 5,264,275 | 11/1993 | Misuda et al. . |
| 5,275,867 | 1/1994 | Misuda et al. . |
| 5,712,027 | 1/1998 | Ali et al. . |

FOREIGN PATENT DOCUMENTS

| | | | |
|---|---|---|---|
| 0450540 A1 | * | 10/1991 | (EP) . |
| 0450540 | | 10/1991 | (EP) . |
| 2564782 | | 11/1985 | (FR) . |
| 3082589 | | 4/1991 | (JP) . |
| 63-307979 | * | 12/1998 | (JP) . |

* cited by examiner

*Primary Examiner*—Pamela R. Schwartz
(74) *Attorney, Agent, or Firm*—Birch, Stewart, Kolasch and Birch, LLP

(57) ABSTRACT

The invention relates to an ink jet recording medium having two coating layers on a base substrate. The surface coating layer of the medium primarily comprises inorganic particulates and the underlayer coating layer of the medium primarily comprises polymeric materials.

More particularly, this invention relates to an ink jet recording medium that performs well within a full environment range.

19 Claims, No Drawings

FULL RANGE INK JET RECORDING MEDIUM

This application is a continuation of application Ser. No. 08/919,815 filed on Aug. 29, 1997 now U.S. Pat. No. 5,888,635, which was a continuation of application Ser. No. 08/630,987, filed Apr. 12, 1996 now abandoned, which was a continuation of application Ser. No. 08/288,265 filed Aug. 11, 1994 now abandoned, which was a continuation-in-part application of application Ser. No. 08/287,357 filed Aug. 8, 1994, now abandoned, the entire contents of which are hereby incorporated by reference.

FIELD OF THE INVENTION

This invention relates to an ink jet recording medium having two coating layers on a base substrate. The surface layer of the medium primarily comprises inorganic particulates and the underlayer of the medium primarily comprises polymeric materials. More particularly, this invention relates to an ink jet recording medium that performs well within a full environment range.

BACKGROUND OF THE INVENTION

Recently, ink jet printing technology has been used for presentation, graphic arts, engineering drawing and home office applications. The performance requirements for ink jet media used for these applications are quite stringent. The media have to provide fast drying, good color fidelity, high image resolution, and archivability. In addition, the media must perform at different environmental conditions and be capable of being produced at an acceptable cost.

There are many commercial products and proposed designs available in the field. Both inorganic materials and organic polymers have been used in these designs. For example, U.S. Pat. Nos. 5,264,275, 5,275,867, 5,104,730, 4,879,166, 4,780,356 proposed designs using porous particles such as pseudo-boehmite, and U.S. Pat. Nos. 4,503,111, 3,889,270, 4,592,951, 5,102,717, 3,870,549, 4,578,285, 5,101,218 and 5,141,599 proposed designs using organic polymers such as poly(vinyl pyrrolidone), poly(alkyl vinyl ether-maleic acid), a mixture of gelatin and starch, a water insoluble polymer containing a cationic resin, poly(ethylene oxide), and crosslinked poly(vinyl alcohol). Although some of these designs improved some properties, none of them meets all functional performance requirements of a commercial ink jet recording medium. More importantly, none of these designs perform satisfactorily in a full environment range, of from low to high relative humidities (RH). For example, prior known media using inorganic particulates cause ink migration at high humidity and poor handling properties, and prior known media using organic polymers did not reliably give good image resolution and often gave low optical density at low humidity. U.S. Pat. No. 5,264,275 discloses a composite consisting of both inorganic particulate and organic polymer layers. However, this design uses three coating layers on a surface of a base substrate, with the designed product containing two different inorganic particulate layers.

SUMMARY OF THE INVENTION

We have recently designed an ink jet recording medium that provides an optimal performance in terms of quality, functionality and cost. The present inventive medium does not require the presence of three coating layers on a surface of a base substrate. Instead, the present inventive media are only required to have an inorganic particulate surface layer and a polymeric underlayer on a given surface of a base substrate. The surface layer primarily comprises inorganic particulates and the underlayer primarily comprises polymeric materials. In this regard, the inorganic particulates in the surface layer provide good image resolution and high optical density, while the polymeric materials in the underlayer provide a reservoir for an ink vehicle. The underlayer also provides a dye-fixing function when dye-fixing materials such as polymeric quaternary ammonium salts are also present therein.

The ink jet recording media encompassed by the present invention are full range ink jet recording media that perform well within a wide range of humidities. For example, they perform well at both a low humidity (about 20% RH) and a high humidity (about 80% RH), as well as at humidities therebetween.

DETAILED DESCRIPTION OF THE INVENTION

In the present invention, the base substrate can be a transparent plastic, an opaque plastic, a translucent plastic or a paper. Suitable polymeric materials for use as the base substrate include polyester, cellulose esters, polystyrene, polypropylene, polyvinyl acetate, polycarbonate, and the like. A polyethylene terephthalate polyester film is a particularly preferred base substrate. Further, while almost any paper can also be used as the base substrate, clay coated papers are particularly preferred as base substrate papers.

The thickness of the base substrate is not particularly restricted but should generally be in the range of from about 2 to about 10 mils, preferably from about 3.0 to about 5.0 mils. The base substrate may be pretreated to enhance adhesion of the polymeric underlayer coating thereto.

The surface layer of the medium in present invention primarily comprises one or more inorganic particulates, in a total amount of from about 75 to about 100 wt %, preferably from about 80 to about 100 wt %, based on the total weight of solids in the surface layer. Although the particle size of the inorganic particulates is not specifically limited, for a transparent ink jet recording medium of the present invention the average particle size of the particulates should be smaller than about 1 micrometer, preferably smaller than about 0.5 micrometer.

The surface layer of the inventive medium may also contain a certain percentage of one or more polymeric materials as a polymeric binder, if so desired. In such an instance, the ratio of the inorganic particulates to the polymeric binder should be equal to or higher than about 3:1, and preferably equal to or higher than about 4:1, on a weight/weight basis.

Typical examples of inorganic particulates which may be used in the surface layer of the present inventive ink jet recording medium include silica, alumina, titanium oxide, alumina hydrate, pseudo-boehmite, zinc oxide, tin oxide, and silica-magnesia, bentonite, hectorite, mixtures thereof, and the like.

Typical examples of polymeric binders which may be used in the surface layer of the present inventive ink jet recording media are hydrophilic polymeric materials such as poly(vinyl alcohol), poly(vinyl pyrrolidone), gelatins, poly (vinyl acetate), poly(acyclic acids), poly(ethylene oxide), cellulose ethers, hydroxypropylcyclodextrin, poly (2-ethyl-2-oxazoline), proteins, water-soluble gums, poly (acrylamide), alginates, mixtures thereof, and the like. Also, copolymers having hydrophilic components can be used as the polymeric binders, if so desired.

The underlayer of the present inventive ink jet medium primarily comprises one or more polymeric materials, in a total amount of from about 60 to about 100 wt %, preferably from about 70 to about 100 wt %, based on the total weight of solids in the underlayer. At least one of the polymeric materials present in the underlayer should be a water-soluble or water-imbibing component. The water-imbibing component should absorb water but not be soluble in water. Exemplary of such water-imbibing or water-soluble components are poly (vinyl alcohol), poly (vinyl pyrrolidone), gelatin, poly (vinyl acetate), poly (acrylic acid), hydroxyethylcellulose, poly (ethylene oxide), hydroxypropylcellulose, poly (2-ethyl-2-oxazoline), proteins, carboxymethylcellulose, alginate, water-soluble gums, 2-hydroxyethyl acrylate, N-hydroxyethyl acrylamide, N-hydroxymethyl acrylamide, dimethylaminoethyl methacrylate, mixtures thereof, and the like. The water-soluble or water-imbibing component can be a component of a homopolymer, a copolymer or a polymer blend.

In order to achieve archivability, a polymeric quaternary ammonium salt may also be used in the underlayer of the present inventive ink jet recording mediums, if so desired. The polymeric quaternary ammonium salts used in the underlayer should preferably be: (1) of high molecular weight, and more preferably possess an average molecular weight larger than 10,000; (2) soluble in a selected organic solvent system (e.g., methyl ethyl ketone, toluene, isopropyl alcohol, mixtures thereof, and the like); and (3) compatible with the polymeric materials in the underlayer. Exemplary polymeric quaternary ammonium salts include those disclosed in U.S. Pat. No. 5,206,071, which is incorporated herein by reference in its entirety.

The thickness ratio of the surface layer to the underlayer has an impact on the medium's performance.

Thus, in the inventive ink-jet recording media, the thickness ratio of the surface layer to the underlayer is preferably within the range of from about 10:1 to about 1:10. The thickness of the total coatings (i.e., surface layer and underlayer) is preferably and usually within the range of from about 2 micrometers to about 40 micrometers, and more preferably from about 4 micrometers to about 30 micrometers.

In practice, various additives may also be employed in the coating layers (i.e., the surface layer and underlayer). These additives can include surface active agents which control the wetting or spreading action of the coating solutions, antistatic agents, suspending agents, particulates which control the friction or surface contact areas, and acidic compounds to control the pH of the coatings, among other properties, of the coated product. Other additives may also be used, if so desired.

A surface of the base substrate which does not bear either the underlayer or surface layer coating may have a backing material placed thereon in order to reduce electrostatic charge and to reduce sheet-to-sheet friction and sticking, if so desired. The backing material may either be a polymeric coating, a polymer film or a paper.

Any of a number of coating methods may be employed to coat an appropriate underlayer and surface layer coating composition onto the base substrate of the present inventive mediums. For example, roller coating, wire-bar coating, dip coating, extrusion coating, air knife coating, curtain coating, slide coating, blade coating, doctor coating or gravure coating, may be used and are well known in the art.

The following Examples are given merely as illustrative of the invention and are not to be considered as limiting.

EXAMPLE 1

A coating composition was prepared according to the following formulation:

| | |
|---|---|
| Surface layer: | |
| DISPAL 18N4-20[1] (20 wt %) | 80.0 parts |
| AIRVOL 840[2] (10 wt %) | 20.0 parts |
| Underlayer: | |
| PVP-K90[3] | 9.7 parts |
| Acrylic copolymer[4] (40 wt %) | 10.7 parts |
| Quaternary polymer[5] (35 wt %) | 9.8 parts |
| Particulate[6] | 0.4 parts |
| DOWANOL PM[7] | 15.0 parts |
| MEK[8] | 53.0 parts |

[1]Colloidal alumina, Vista Chemical Company.
[2]Poly(vinyl alcohol), Air Products and Chemicals, Inc.
[3]Poly(vinyl pyrrolidone), GAF Corporation.
[4]A copolymer of methyl methacrylate and hydroxyethyl methacrylate.
[5]Quaternized copolymer of methylmethacrylate and dimethylaminoethyl methacrylate.
[6]Glass bead, the average particle size is about 28 um.
[7]Propylene glycol monomethyl ether, Dow chemical Corporation.
[8]Methyl ethyl ketone The coating of the underlayer was applied to a polyester film (ICI Films) using a No. 42 Meyer rod. After drying the underlayer at about 120 C for about 2 minutes, the coating of surface layer was applied using a No. 60 Meyer rod at about 120 C for about 2 minutes.

EXAMPLE II

A coating composition was prepared according to the following formulation:

| | |
|---|---|
| Surface layer: | |
| DISPAL 18N4-20 (20 wt %) | 67.0 parts |
| AIRVOL 603 (10 wt %)[1] | 33.0 parts |
| Underlayer: | |
| PVP K-90 | 12.0 parts |
| Acrylic copolymer (40 wt %) | 7.6 parts |
| Particulate | 0.3 parts |
| Citric acid | 0.2 parts |
| DOWANOL PM | 19.0 parts |
| MEK | 49.7 parts |
| Methanol | 10.0 parts |

[1]Poly(vinyl Alcohol), Air Products and Chemicals, Inc.

The coating of the underlayer was applied to a polyester film (ICI Films) using a No. 48 Meyer rod. After drying the underlayer at about 120 C for about 2 minutes, the coating of surface layer was applied using a No. 26 Meyer rod at about 120 C for about 2 minutes.

EXAMPLE III

A coating composition was prepared according to the following formulation:

| | |
|---|---|
| Surface layer: | |
| NALCO 2327[1] (40 wt %) | 13.1 parts |
| Hydroxyethyl cellulose[2] | 0.4 parts |
| Methyl cellulose[3] | 0.3 parts |
| Water | 86.3 parts |
| Ammonia | 0.2 parts |

-continued

| Underlayer: | |
|---|---|
| PVP K-90 | 12.0 parts |
| Acrylic copolymer (40 wt %) | 7.6 parts |
| Particulate | 0.3 parts |
| Citric acid | 0.2 parts |
| DOWANOL PM | 19.0 parts |
| MEK | 49.7 parts |
| Methanol | 10.0 parts |

[1]Colloidal silica, Nalco Chemical Company.
[2]Union Carbide Corporation.
[3]Dow Chemical Company.

The coating of the underlayer was applied to a polyester film (ICI Films) using a No. 48 Meyer rod. After drying the underlayer at about 120 C for about 2 minutes, the coating of the surface layer was applied using a No. 16 Meyer rod at about 120 C for about 2 minutes.

COMPARATIVE EXAMPLE I

The commercial ink jet receiving sheet (CANON CT 101, CTR) using inorganic particulate as an image receptive layer.

COMPARATIVE EXAMPLE II

The Commercial ink jet receiving sheet (HEWLETT PACKARD LX, Lot No. 851432) using organic polymers as an image receiving layer.

Comparative Testing

The ink jet recording medium of the present invention (as exemplified by the medium of the above Examples I–III), and the above ink jet medium of Comparative Examples I–II were subjected to the following comparative testing procedures.

Ink Migration Test

Test samples from Examples I–III and Comparative Example I were printed on a Hewlett Packard DESKJET Printer 1200C at 23 C/50%RH. The printed samples were then stored in a thermostat controlled environment chamber at 30 C/80%RH for 72 hours. Ink migration was then measured with an ACU-RITE microscope (Automation Components, Inc.). Test results are provided in Table I, below. Generally, a lower value in this test denotes a better result, since excessive ink migration can negatively effect image resolution and can result in an unusable product.

Optical Density Test

Test samples from Examples I–III and Comparative Example II were printed on a Hewlett Packard DESKJET Printer 1200C at 23 C/50%RH. The printed samples were then stored in a thermostat controlled environment chamber at 15 C/20%RH for 24 hours. The optical density was measured with a MACBETH TD 904 (Macbeth Process Measurements). Test results are provided in Table I, below. Generally, in this test a higher optical density value denotes a better result, since a low optical density can cause poor color fidelity in a printed ink jet recording medium.

TABLE I

Comparative Testing Results

| Receiving Sheet | Ink Migration[a] (mil) | Optical Density[b] |
|---|---|---|
| Example I | 14.5 | 1.98 |
| Example II | 4.3 | 1.72 |
| Example III | 3.5 | 1.71 |
| Comparative Example I | 22.5 | — |
| Comparative Example II | — | 1.56 |

[a]The migration of a red ink line in a yellow ink background was measured.
[b]The cyan ink density was measured.

The results reported in Table I evidence that the present inventive full range ink jet recording media possess a higher optical density than an organic polymer based medium at a low humidity (i.e., Comparative Example II), and possess a lower ink migration than an inorganic particulate based medium at a high humidity (i.e., Comparative Example I).

More specifically, with respect to the tested medium of Comparative Example I, the comparative testing shows that a high level of ink migration was associated with this product, and as a result its image resolution was deteriorated and the product was unusable. Similarly, the comparative testing shows that the printed ink jet recording medium of Comparative Example II, possessed a low optical density and a hence poor color fidelity. The comparative testing further shows that such undesirable properties of high ink migration and low optical density are not associated with the present inventive ink jet recording media.

Each of the patents and/or publications which have been referred to herein are incorporated herein by reference in their entirety.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A transparent full range ink jet recording medium, which comprises:

(a) a base substrate having a first and a second surface;

(b) an underlayer on the first surface of the base substrate, the underlayer comprising poly(vinyl pyrrolidone) and a copolymer of methyl methacrylate and hydroxyethyl methacrylate in a total amount of from about 80 to about 100 wt %, based on the total wt % of solids in the underlayer; and (c) a surface layer on a surface of the underlayer, the surface layer comprising at least about 80 wt %, based on the total wt % of solids in the surface layer, of one or more inorganic particulates having an average particle size smaller than 0.5 micrometers, and further comprising one or more polymeric binders, the ratio of inorganic particulates to the polymeric binders being equal to or greater than about 4 to 1 on a weight/weight basis.

2. The transparent medium according to claim 1, wherein the thickness ratio of the surface layer to the underlayer is within the range of from about 10:1 to about 1:10.

3. The transparent medium according to claim 1, wherein the base substrate is a transparent plastic.

4. The transparent medium according to claim 1, wherein the inorganic particulates in the surface layer are selected from the group consisting of silica, alumina, alumina hydrate, pseudoboehmite, titanium oxide, zinc oxide, tin oxide, silica-magnesia, betonite, hectorite, and mixtures thereof.

5. The transparent medium according to claim 1, wherein the polymeric binder in the surface layer is selected from the group consisting of poly(vinyl alcohol), poly(vinyl pyrrolidone), poly(vinyl acetate), cellulose ethers, gelatin, hydroxypropyl cyclodextrin, poly(acrylic acid), poly(2-ethyl-2-oxazoline), water-soluble gums, and mixtures thereof.

6. The transparent medium according to claim 1, wherein said underlayer further comprises a polymeric quaternary ammonium salt.

7. The transparent medium according to claim 1, wherein said underlayer further comprises a polymeric quaternary ammonium salt which possesses an average molecular weight of greater than 10,000, is soluble in an organic solvent, and is compatible with the polymeric materials in the underlayer.

8. The transparent medium according to claim 1, wherein a backing material is on the second surface of the base substrate.

9. The transparent medium according to claim 1, wherein the base substrate is selected from the group consisting of a polyester film, a cellulose ester film, a polystyrene film, a polypropylene film, a polyvinyl acetate film, and a polycarbonate film.

10. A full range ink jet recording medium, which comprises (a) an opaque base substrate having a first and a second surface;

(b) an underlayer on the first surface of the base substrate, the underlayer comprising poly(vinyl pyrrolidone) and a copolymer of methyl methacrylate and hydroxyethyl methacrylate in a total amount of from about 80 to about 100 wt % of one or more polymeric materials, based on the total wt % of solids in the underlayer; and (c) a surface layer on a surface of the underlayer, the surface layer comprising at least about 80 wt %, based on the total wt % of solids in the surface layer, of one or more inorganic particulates having an average particle size smaller than 0.5 micrometers, and further comprising one or more polymeric binders, said ratio of inorganic particulates to the polymeric binders being equal to or greater than about 4 to 1 on a weight/weight basis; and wherein the underlayer is transparent, the surface layer is transparent, and said inorganic particles in the surface layer have an average particle size smaller than 0.5 micrometers.

11. The medium according to claim 10, wherein the thickness ratio of the surface layer to the underlayer is within the range of from about 10:1 to about 1:10.

12. The medium according to claim 10, wherein the base substrate is selected from the group consisting of, a translucent plastic, an opaque plastic and a paper.

13. The medium according to claim 10, wherein the inorganic particulates in the surface layer are selected from the group consisting of silica, alumina, alumina hydrate, pseudoboehmite, titanium oxide, zinc oxide, tin oxide, silica-magnesia, betonite, hectorite, and mixtures thereof.

14. The medium according to claim 10, wherein the polymeric binder in the surface layer is selected from the group consisting of poly (vinyl alcohol), poly (vinyl pyrrolidone), poly (vinyl acetate), cellulose ethers, gelatin, hydroxypropyl cyclodextrin, poly (acrylic acid), poly (2-ethyl-2-oxazoline), water-soluble gums, and mixtures thereof.

15. The medium according to claim 10, wherein said underlayer further comprises a polymeric quaternary ammonium salt.

16. The medium according to claim 10, wherein said underlayer further comprises a polymeric quaternary ammonium salt which possesses an average molecular weight of greater than 10,000, is soluble in an organic solvent, and is compatible with the polymeric materials in the underlayer.

17. The medium according to claim 10, wherein a backing material is on the second surface of the base substrate.

18. The medium according to claim 10, wherein the base substrate is selected from the group consisting of a polyester film, a cellulose ester film, a polystyrene film, a polypropylene film, a polyvinyl acetate film, and a polycarbonate film.

19. The medium according to claim 10, wherein the base substrate is a clay coated paper.

* * * * *